US005979021A

United States Patent [19]

Swift

[11] Patent Number: 5,979,021

[45] Date of Patent: Nov. 9, 1999

[54] NECKTIE MANAGER

[76] Inventor: Kenneth C. Swift, 2000 Glen Eves Dr, Roswell, Ga. 30076

[21] Appl. No.: 09/149,253

[22] Filed: Sep. 8, 1998

[51] Int. Cl.[6] ..... A44B 6/00

[52] U.S. Cl. ..... 24/66.6; 24/66.4; 24/546; 24/554

[58] Field of Search ..... 24/66.6, 66.7, 24/66.5, 66.4, 66.3, 66.2, 67.9, 546, 552, 553, 554

[56] References Cited

U.S. PATENT DOCUMENTS

| | | |
|---|---|---|
| 2,589,036 | 3/1952 | Bender . |
| 3,400,434 | 9/1968 | Pazeotopoulos . |
| 3,494,003 | 2/1970 | Bower, Jr. . |
| 3,968,544 | 7/1976 | Sinclair . |
| 4,839,945 | 6/1989 | Price et al. . |
| 4,959,889 | 10/1990 | Ciaravino . |
| 5,007,139 | 4/1991 | Ahern . |
| 5,715,538 | 2/1998 | Soll . |

*Primary Examiner*—Victor N. Sakran
*Attorney, Agent, or Firm*—William B. Noll

[57] ABSTRACT

A three part necktie manager, such as a tie clasp, having a bar for insertion into a buttonhole of a shirt, a short chain, and a unique wire clamping member. The clamping member, formed of a spring like metal of predetermined length, is configured to form a pair of opposed V-shaped legs, each leg having an inturned or reverse bend end facing its companion end, whereby manual squeezing of the respective V-shaped legs toward each other separates the inturned ends to allow temporary gripping of the rear face of the tie.

6 Claims, 1 Drawing Sheet

NECKTIE MANAGER

FIELD OF THE INVENTION

This invention is directed to the field of necktie control devices, such as a tie clasp, where the device of this invention, when worn, is not readily visible to a person viewing the wearer thereof.

BACKGROUND OF THE INVENTION

The present invention relates to an effective necktie control device, commonly known as a tie clasp, that is generally hidden to an observer of the wearer thereof. Such device is adapted to be worn by a user wearing a necktie on a collared shirt having a plurality of button holes and complementary buttons to close the shirt. The necktie, typically a four-in-hand type necktie, is an article of wearing apparel that has a generally long and narrow shape with end portions that have different widths. In use it encircles the neck of the wearer, and is tied in a knot adjacent to the neck with the end portions lying flat on the garment of the wearer with the larger end portion covering the smaller.

The purpose of the necktie is principally decorative. The shape during wearing and degree of movement during wearing are of importance to the wearer. The tie is constructed so that the knot, the folds of the material of the tie and the ends all assume and maintain a particular shape and position through long hours of wearing, yet return to the original position and shape upon removal. Of particular importance is that the end portions lie essentially flat, the larger one over the smaller adjacent the garment of the wearer and not freely swing under conditions of wind and wearer motion, and for safety concerns. It is of importance to some wearers that the retention means not be visible from the front.

The control of unwanted movement of the necktie by the user has been a concern for a number of years. The prior art is replete with references to the use of some type of device to achieve such goal. Such prior art is reflected in the following U.S. patents:

a.) No. 5,715,538, to Soil, relates to a necktie securing device for securing to a shirt front a necktie having a tail, an apron and a label, the label being attached to a rear surface of the apron, to a shirt front when the tail is disposed within an opening formed by the label and the apron. The device includes a first clip demountably attachable to the tail and having a first VELCRO material covered joining surface and a second clip demountably attachable to an overlapping edge of the shirt front and having a second joining surface covered by complementary VELCRO material. The second joining surface of the second clip is engageable with the first joining surface of the first clip.

b.) No. 5,007,139, to Ahern, discloses a necktie retainer that restricts movement of the necktie by providing a fill flexure tensor member attached to the upper garment of the wearer, a necktie movement governing length of filamentary material with fill flexure, distributed direct mechanical attachment to each rear folded portion of the larger end of the necktie. The movement restriction is facilitated through the use of a necktie with a cross member and employing a detachable member on the tensor member that for retention uses the cross member width dimension and for attachment and release uses the cross member thickness dimension. The retainer accommodates different garment and necktie constructions does not have parts visible from the front and permits relative movement of the central parts of the necktie.

c.) No. 4,959,889, to Claravino, teaches a totally hidden tie clasp shaped like a safety pin with a sliding pointed tie tack member connected on the rear parallel long member of the pin opposite the front long member so designed so as to securely connect different, or equal, width front and rear pendants of any necktie, in line with each other and then by holding the holding means of the sliding pointed tie tack member connecting them to a wearer's shirt by piercing the rear pendant with the piercing point. Thereafter the entire tie is secured by engaging a tie tack clutch with a connecting means and buttonhole engaging crossbar, yet allowing verticle movement of the rear pendant of the tie for loosening and tightening of said necktie without showing evidence of said verticle movement on the front pendant of said necktie and also allowing adjustment of the distance between the shirt of the wearer and the tie clasp.

d.) No. 4,839,945, to Price et al., relates to an invisible tie tail holder constructed and arranged so as to hold the tail of the tie to the backside of the front of the tie without being able to see it from the front of the tie. It is constructed out of steel wire that is bent into a "c" shape which attaches by the pin grabber mechanism to back of the front of the tie and the tail of the tie is fed through the "c" shape which holds it securely to the back of the front of the tie, and it is so illustrated herein.

e.) No. 3,968,544, to Sinclair, teaches a tie clasp shaped generally like a safety pin and having a shirt link attached to its fixed back member. The novelty lies in so proportioning the clasp that it can be used to receive either the back pendant portion or both pendant portions of a four-in-hand necktie. When used only to receive the back pendant, the clasp is preferably made long enough to receive the usually relatively narrow rear pendant but not so long that it extends to either side of the usually rather broad front pendant, thus making the clasp invisible to an observer facing the wearer. Also when so used, the tie clasp has a forward member with a pointed free end, this member being movable between a closed position and an open position, and while open it is thrust into and then out of the rear fold of the front pendant without going completely through the thickness of the tie, thus securing both pendants while at the same time remaining invisible.

f) No. 3,494,003, to Bower, Jr., discloses a necktie holder which is not outwardly visible and which do not damage the appearance of the tie material surface. The holding means disclosed attach the underneath fold of the outer appearing end of the necktie and the underneath end of the necktie together. The necktie position is then maintained by a connection between the holding means and the front of the shit.

g.) No. 3,400,434, to Pazeotopoulos, relates to a tie holder for holding the folds of a four-in-hand necktie in place including a crook with depending arms joined by a reverse bend with such bend adapted to seat on the threads holding a button on a shirt. Tie fold retaining structure extends transversely of the arms at the base of the crook including clamp bar means for clamping on to the rear fold of the tie and a forwardly located pin for pinning the front fold of the tie and holding such front fold together with the rear fold against said clamp bar means.

h.) No. 2,589,036, to Bender, discloses a tie holder comprising a back gripping member for the small end of a four-in-hand tie and a portion of the front of the wearer's shirt, a front gripping member for holding the large end of the tie in symmetrical shape and for holding the end against the back member, and a two-way bow-spring for alternately holding the front and back members in their open position for receiving the tie ends and in their closed position wherein they hold the tie ends in place.

The present invention differs from the foregoing prior art by the use of a manually activated, spring metal necktie clasping member. The manner by which the device hereof differs will become apparent in the following specification, particularly when read in conjunction with the accompanying drawings.

SUMMARY OF THE INVENTION

The invention relates to a necktie movement control device, which when worn to control such necktie is not readily visible from the front. The device comprises a bar sized to be inserted into and temporarily retained by a buttonhole of the wearer's shirt and a necktie wire clamping member consisting of a bent wire of predetermined length and generally configured in a planar manner. The wire has a pair of V-shaped legs joined together at one respective end and a free end, where the free ends have a reverse bend. In operation, a compressive pressure on the V-shaped legs will effect a separation of the free ends to allow temporary gripping and control of the necktie. Finally, a flexible chain is hingedly secured, between the bar and the V-shaped legs, where the components thereof effectively control the necktie's movement.

Accordingly, an object of this invention is to provide an effective device for controlling the movement of a necktie worn by the user thereof.

Another object hereof is the provision of a manually activated necktie movement control device, where the device is not readily visible from the front.

These and other objects will become apparent to those skilled in the art from the following description.

DETAILED DESCRIPTION OF PREFERRED EMBODIMENT

Figures 1, 2, 3:
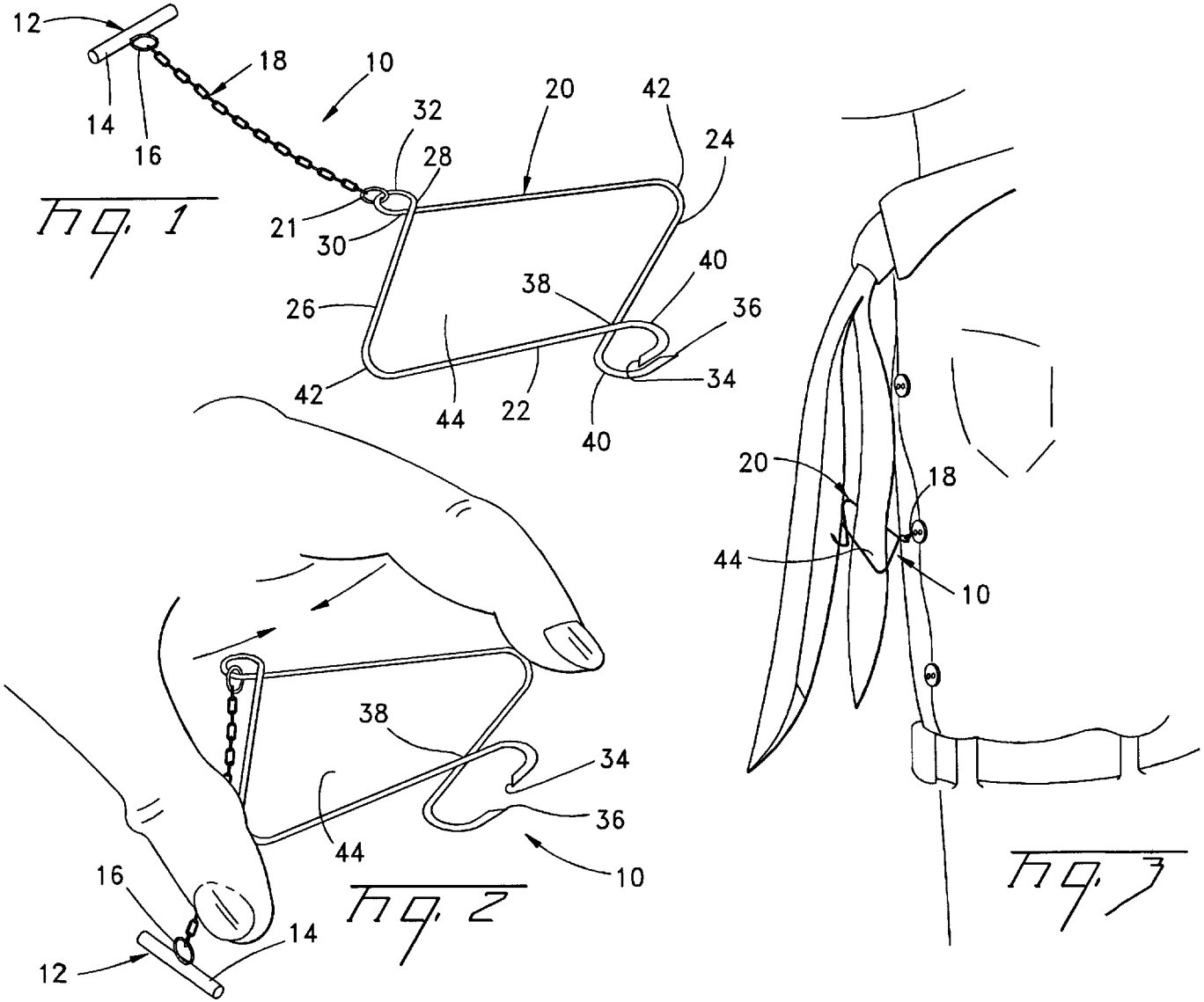
FIG. 1 is a top perspective view of the necktie control device constructed in accordance with the present invention.
FIG. 2 is a perspective view of the device of FIG. 1, further illustrating the manner of manually opening and positioning the device by a wearer thereof.
FIG. 3 is a partial side view illustrating an operable position for necktie movement control by the device of this invention, by a wearer thereof.

The present invention is directed to a necktie managing device to control movement of a necktie. The device 10, as illustrated in the several Figures, where like reference numerals represent comparable components or features throughout the several views, comprises three parts. A first part, the buttonhole bar 12, consists of a short thin bar 14 having a small ring 16, centrally fixed thereon, where the bar 14 is sized to be received in and temporarily secured to a shirt buttonhole, see FIG. 3.

Extending from and hingedly mounted to said small ring 16 is a short chain 18, typically about three inches in length. The distal end 21 of the chain 18 is hingedly mounted to a tie clasping member 20. The clasping member 20 comprises a wire 22, of predetermined length, preferably made of a metal having spring properties, such as stainless steel. The member 20 is configured by forming the wire 22 into a pair of opposed V-shaped legs 24, 26, where complementary ends 28, 30 are joined together, such as in a loop 32, to be secured to the distal end 21. The respective free ends 34, 36, overlap 38 and exhibit a reverse bend 40 of about 180 degrees, see FIGS. 1 and 2.

To secure the device 10 to the backside of a tie, the bases 42 of the respective V-shaped legs 24, 26 are squeezed or urged together (FIG. 2) which opens the free ends 34, 36. In this position, the cooperating free ends 34, 36 may grasp the backside of the outer tie portion as best seen in FIG. 3. When clasped, and the free ends 34, 36 released, the member 20 resiles into gripping contact with the tie. Further, the V-shaped legs 24, 26 define an opening 44 into which the narrow or other end of the necktie may be inserted.

It is recognized that modifications and variations may be made with the components of the necktie manager of this invention, within the spirit and scope of this invention. Accordingly, no limitation should be imposed thereon except as set forth in the appended claims.

I claim:

1. A necktie control device, which when worn by a user is generally not visible to one observing said user, where said device is adapted to be used in conjunction with a necktie worn on a collared shirt having a series of button holes and complementary buttons positioned down the front of said shit, said device comprising:

a.) a bar sized to be inserted into and temporarily retained by one of said button holes;

b.) a necktie wire clamping member comprising a bent wire of predetermined length and generally configured in a planar maimer, said wire having a pair of V-shaped legs joined together at one respective end and a free end, said free end having a reverse bend, whereby a compressive pressure on said V-shaped legs will effect a separation of said free ends to allow temporary gripping and control of said necktie;

c.) a chain hingedly secured to and between said bar and said V-shaped legs; and d.) Wherein the reverse bend of said free end is approximately 180 degrees, such that the respective free ends face each other.

2. The necktie control device according to claim 1, wherein said V-shaped legs are joined at a wire loop to which said chain is secured.

3. The necktie control device according to claim 1, wherein said bar includes a fixed wire loop to which said chain is secured.

4. The necktie control device according to claim 1, wherein said V-shaped legs overlap to define a broad opening therebetween and said free ends.

5. The necktie control device according to claim 1, wherein said clamping member is formed of a metal having spring properties.

6. The necktie control device according to claim 5, wherein said metal is a stainless steel.

* * * * *